United States Patent [19]

Winnick

[11] Patent Number: 4,652,696

[45] Date of Patent: Mar. 24, 1987

[54] PROTECTIVE DEVICE FOR ELECTRICAL RECEPTACLES

[76] Inventor: Stuart Winnick, 924 N. 26th St., Allentown, Pa. 18104

[21] Appl. No.: 677,682

[22] Filed: Dec. 3, 1984

[51] Int. Cl.[4] ..... H01R 13/447

[52] U.S. Cl. ..... 174/67

[58] Field of Search ..... 174/67; 220/242, 337, 220/339; 339/36, 37, 39, 44 R

[56] References Cited

U.S. PATENT DOCUMENTS

| | | | |
|---|---|---|---|
| 2,526,606 | 10/1950 | Gregg | 174/67 |
| 2,880,264 | 3/1959 | Ruskin | 174/67 |
| 2,891,102 | 6/1959 | Grimes | 174/48 X |
| 3,876,071 | 4/1975 | Neal et al. | 220/337 X |
| 4,070,078 | 1/1978 | Chrones | 174/67 X |

FOREIGN PATENT DOCUMENTS

| | | | |
|---|---|---|---|
| 1580037 | 11/1980 | United Kingdom | 339/44 R |

*Primary Examiner*—A. T. Grimley
*Assistant Examiner*—D. A. Tone
*Attorney, Agent, or Firm*—Burns, Doane, Swecker & Mathis

[57] ABSTRACT

An electrical receptacle protective device includes a base plate which replaces the conventional face plate of an electrical outlet, and a cover which is attached to the base plate. The cover is secured to the base plate by three latches. In order to remove the cover from the base plate and access the outlet, all three latches must be released simultaneously. These latches are spaced in a manner such that two adult sized hands are required to release all three simultaneously. The spacing of the latches, combined with the requirement for their simultaneous actuation, inhibits the removal of the cover by a small child who does not have sufficient dexterity to carry out these operations.

5 Claims, 5 Drawing Figures

10
12
14
16
18
20
22
24
26
28
30
32
34
36

PROTECTIVE DEVICE FOR ELECTRICAL RECEPTACLES

BACKGROUND OF THE INVENTION

The present invention is directed to a safety device for inhibiting access to an electrical outlet.

The need to cover exposed electrical outlets as a precaution against injury to small children is readily apparent. A simple form of protection is provided by commonly available covers that consist of a small plate of plastic having a shape similar to that of a socket and a pair of laterally projecting prongs that are similar to the prongs on an electrical plug and that fit into the openings in the socket to hold the cover in place. While this type of cover provides some form of protection, it is practically effective only against the smallest of children. Since it can be removed by simply pulling it away from the receptacle, children as young as one year old who have the physical dexterity to grasp the cover can easily remove it.

Accordingly, more sophisticated safety devices have been developed to protect children who have some degree of physical strength or dexterity but who are not old enough to appreciate the dangers associated with electrical receptacles. For example, U.S. Pat. No. 2,526,606 discloses a protective hood that snaps on to a special base plate. The hood engages the base plate by means of ears provided with hook portions, and removal of the hood is accomplished by flexing one of its two longitudinal edges inwardly to disengage the hooks on the hood from the base plate. The patent discloses that the hood is made of sufficiently strong material so that the pressure required to release it cannot be exerted by the average small child. In other words, the effectiveness of this device in limiting the child's access to the receptacle is dependent upon the child's physical strength. While the average small child may not be able to flex the hood inwardly with his hand, it will be appreciated that he may be able to strike the hood, using a toy or other implement, with sufficient force to disengage it from the base plate. Accordingly, protective devices that rely merely upon a child's limited strength may not be effective in all situations.

Another approach to the protection of children from electrical outlets has been to de-energize the outlet when it is exposed. For example, U.S. Pat. No. 2,439,708 discloses an electrical outlet with a hinged cover box having arms attached thereto which cooperate with a switch that connects the electrical lead wires to the contacts of the outlet. In operation, when the cover box is in a closed position (which prevents access to the outlets), the contacts are energized. However, as soon as the cover box is unlatched and swung away from the receptacle, to expose the outlets, the contacts become de-energized.

While it will be appreciated that this feature of turning the power off when the socket is exposed may be somewhat more effective than the approaches which merely limit physical access to the outlet, it is also rather complex and hence costly to implement. Furthermore, repeated opening and closing of the cover box will subject the various components to wear, eventually requiring repair or replacement of the entire receptacle. As such, this type of approach is not subject to widespread commercial acceptance.

OBJECTS AND BRIEF STATEMENT OF THE INVENTION

It is a general object of the present invention to provide a novel device for protecting small children from the dangers posed by exposed electrical outlets.

It is a more specific object of the invention to achieve this general object by a means which is simple and inexpensive to produce and yet which is rendered effective by requiring manual dexterity, beyond the level typically exhibited by the average small child, in order to open it.

In accordance with the present invention, an electrical receptacle protective device comprises a base plate which can replace the conventional face plate of an electrical outlet, and a cover which is attached to the base plate. The cover is secured to the base plate by an assembly of latches, preferably at least three in number. In order to remove the cover from the base plate and access the outlet, all three latches must be released simultaneously. These latches are spaced around the cover in a manner such that two adult sized hands would be required to release all three simultaneously. The spacing of the latches, combined with the requirement for their simultaneous actuation, inhibits the removal of the cover by a small child who does not have sufficient dexterity to carry out these operations.

Further features and advantages of the invention are described hereinafter with reference to particular embodiments illustrated in the accompanying drawings.

DESCRIPTION OF THE ILLUSTRATED EMBODIMENTS

In the following description, reference is made to particular embodiments of the invention in order to facilitate an understanding of its underlying principles. However, it will be appreciated by those having familiarity with this technology that the invention is not limited to the illustrated embodiments. Rather, the practical concepts which underlie the invention can be embodied in a number of different forms. For example, while the illustrated embodiments show an electrical receptacle having two sockets, the invention is equally applicable to receptacles having a greater or lesser number of sockets. Similarly, other adaptations of the invention should become readily apparent.

Figures 1, 2, 3:
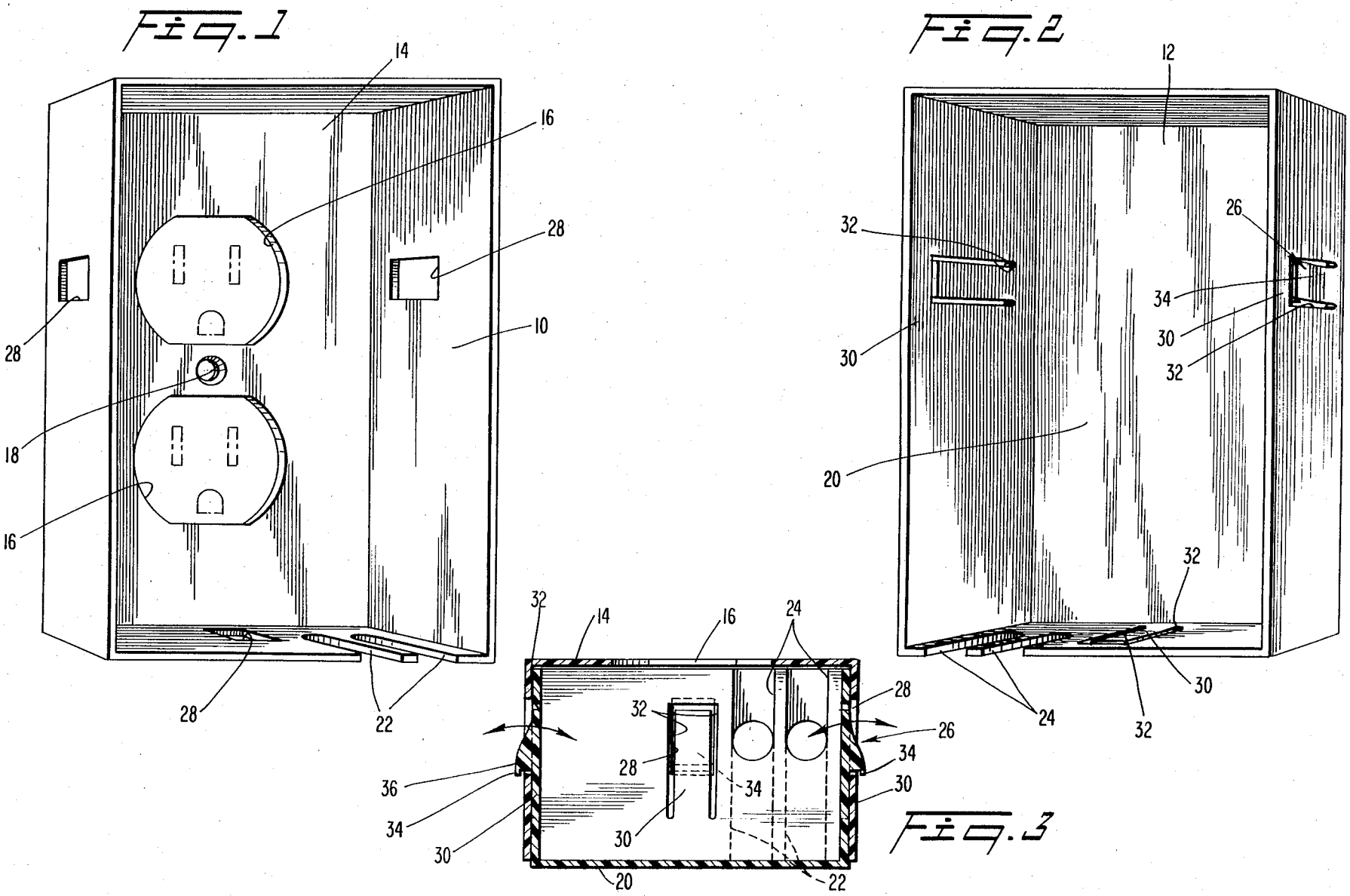
FIG. 1 is a perspective view of the bottom or base portion of a first embodiment of a safety device for an electrical receptacle incorporating the present invention.
FIG. 2 is a perspective view of the top or cover portion of the device illustrated in FIG. 1.
FIG. 3 is a cross-sectional side view illustrating the manner of engagement of the latches to prevent removal of the top portion from the bottom portion.

Referring now to FIGS. 1 and 2, a first embodiment of the invention comprises a two-piece box-like structure consisting of a base 10 and a cover 12. The base includes a bottom wall 14 and four side walls that are integrally attached thereto. The bottom wall 14 can be shaped the same as a conventional face plate on an electrical outlet and used in place thereof. Accordingly, the bottom wall includes a pair of openings 16 to accommodate the sockets of the outlet, and a central screw hole 18 for attachment to the receptacle in a conventional manner.

The cover 12 of the protective device comprises a top wall 20 and four integral side walls attached thereto. The cover 12 is slightly smaller than the bottom 10 so that, as best illustrated in FIG. 3, the four side walls of the cover fit within the side walls of the base.

One of the side walls of the base 10 is provided with a pair of slots 22 and the corresponding side wall of the cover 12 has a similarly located pair of slots 24. These two pairs of slots cooperate when the cover is placed inside the base, as shown in FIG. 3, to form openings through which electrical cords can pass. In this manner, an electrical appliance can be plugged into one of the sockets and the safety device can be closed to prevent a child from removing the plug from the outlet.

To inhibit removal of the cover 12 from the base 10 when the safety device is closed, the cover is held in place by means of spring-type latches 26 located on the side walls of the cover. These latches are disposed within corresponding apertures 28 in the side walls of the base 10. Referring to FIG. 2, each latch 26 comprises a tongue portion 30 formed by a U-shaped cutout 32 in the side wall of the cover. The cover is made of a flexible material, preferably a plastic, and therefore the lower end of the tongue (near the base of the U-shaped cutout 32) can pivot into and out of the plane of the wall, as indicated by the arrows in FIG. 3. This lower end of the tongue is provided with hook portion 34.

In an unbiased state, the latch assumes the position shown in FIG. 3, wherein the tongue portion lies in the plane of the wall. In this position, if an attempt is made to remove the cover 12 from the base 10, the hook 34 will engage the upper edge 36 of the corresponding aperture 28 in the side wall of the base and thereby thwart the attempt. Accordingly, in order to remove the cover 12 from the base 10, all of the various latches 26 must be pressed inwardly simultaneously in order to permit their hook portions 34 to pass by the apertures 28 without engaging the side walls.

In accordance with the present invention, plural latches are provided on the protective device in order to provide a first level of complexity that inhibits unwanted opening of the device by a small child. More particularly, a small child may be able to depress one of the latches at a time, but this will not prove sufficient to open the device. Rather, all latches must be actuated simultaneously before the cover can be removed, which can prove to be difficult for a small child. While two latches will work toward this end, the number of latches is preferably at least three in order to provide a greater level of difficulty for the child.

In accordance with a further feature of the invention, a second level of complexity is provided by spacing the latches around the device by distances which are difficult, if not impossible, to span with the fingers of a small child's hand. For example, a shown in FIGS. 1 and 2, one of the latches can be located on one of the shorter side walls of the cover 12, and two other latches can be respectively located on the two longer walls near to the opposite short wall. With such spacing, a hand which is as large as an adult's would be required to grasp at least two of the latches at the same time. Thus, the child's ability to simultaneously release all of three latches is made more difficult.

As a further feature of the invention, the base and cover portions of the protective device could be made to fit together precisely, although not necessarily tightly. With such a fit, if the cover is not extracted evenly from the base, it will jam, thus preventing its removal.

Figure 4:
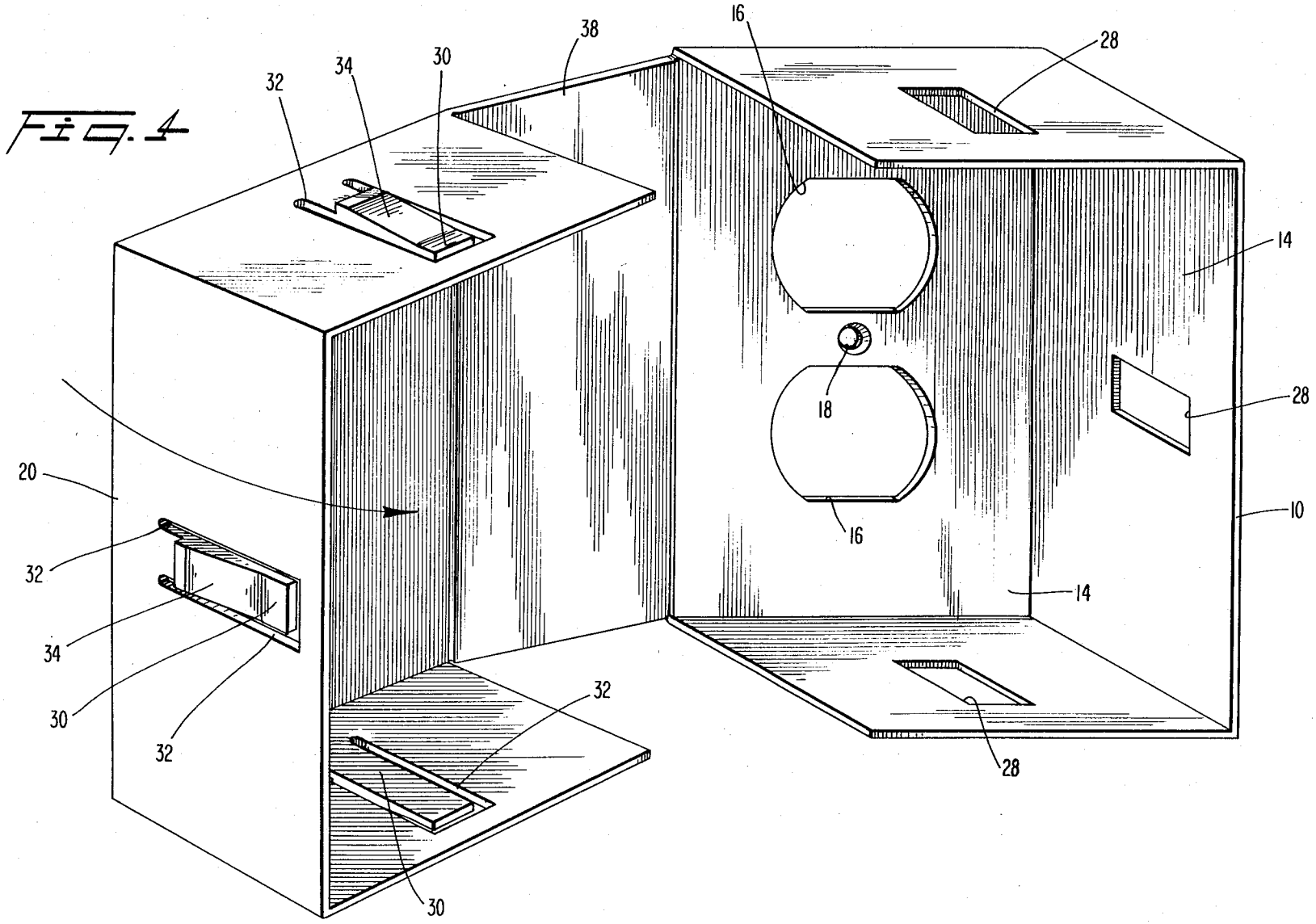
FIG. 4 is a perspective view of a second embodiment of the invention in an open configuration.
Figure 5:
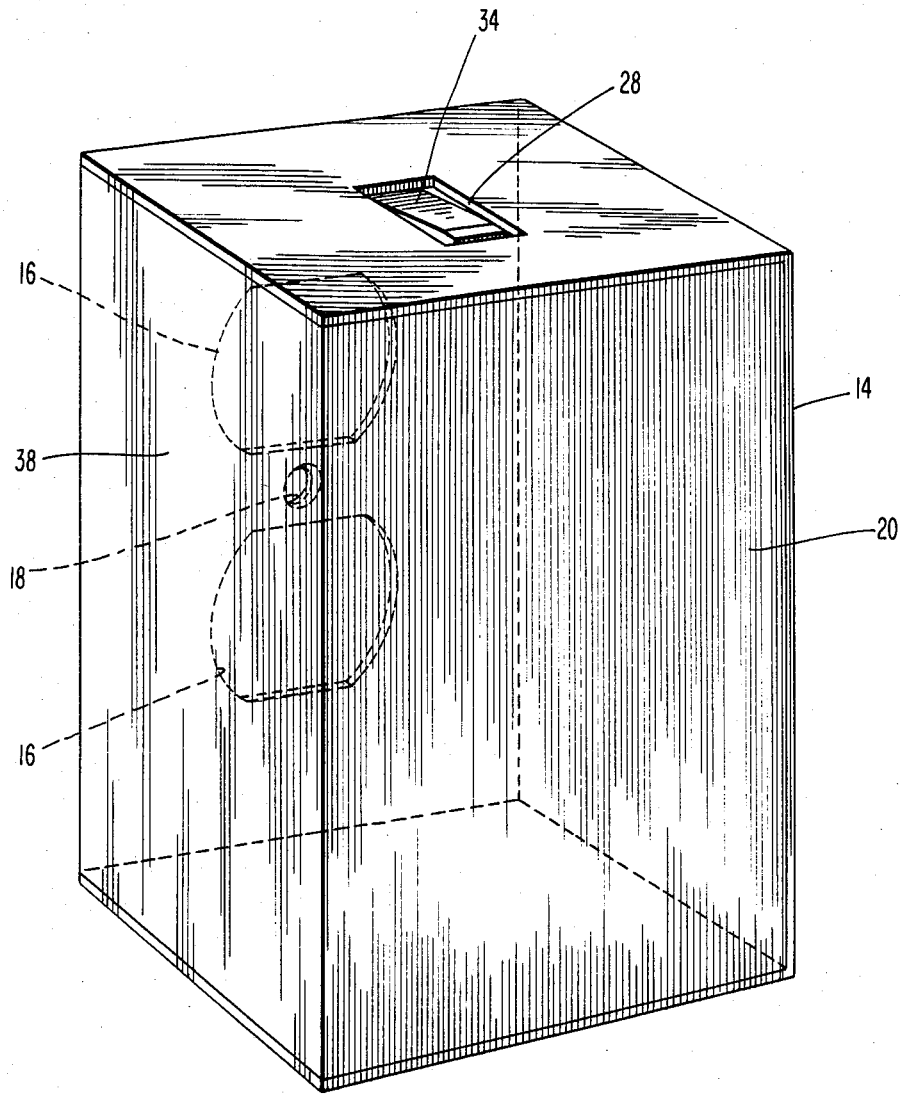
FIG. 5 is a perspective view of the embodiment of FIG. 4 in the closed configuration.

While a preferred embodiment of the invention has been illustrated as a protective device comprised of a separate base and cover, the invention is not so limited in its broadest aspects. For example, the top wall of the cover and the bottom wall of the base could be hingedly connected to one another via a side wall common to both. Such an embodiment is illustrated in FIGS. 4 and 5. In this embodiment, the line of intersection between one of the side walls 38 and each of the bottom wall 14 and the top wall 20 comprises a flexible hinge. In all other respects, the embodiment of FIGS. 4 and 5 operates the same and employs the same underlying principles as the first-described embodiment.

It will be appreciated by those of ordinary skill in the art that the present invention can be embodied in other specific forms without departing from the spirit or essential characteristics thereof. For example, while the various latches have been illustrated as being respectively disposed on separate side walls, it is possible to place two or more latches on the same side wall. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A protective device for limiting access to an eletrical receptacle, comprising:

a box-like member including a base having a bottom wall and four side walls attached thereto, and a cover having a top wall and four side walls attached thereto, said base and said cover being dimensioned such that the side walls of one fit inside the side walls of the other; and at least three latches for securing said cover to said base and thereby enclosing said box-like member, said latches being normally biased to a state which causes said cover to be secured to said base so that all latches must be actuated simultaneously in order to permit said cover to be disengaged from said base, one of said latches being disposed on one of said side walls and the other two latches teing disposed on the two side walls adjacent to said one side wall and at locations remote from said one side wall to inhibit simultaneous actuation thereof by small children.

2. The protective device of claim 1 wherein each of said latches comprises a hook member disposed on a flexible portion of a side wall of one of said cover and base, and a corresponding aperture in a side wall of the other of said cover and base in which said hook member is disposed when said cover is secured to said base.

3. The protective device of claim 2 wherein each of said latches further comprises a tongue portion that normally lies in the plane of the side wall and that is formed by a U-shaped cutout in the side wall, said hook member being disposed on an end of the tongue portion adjacent the base of the cutout.

4. The protective device of claim 1 wherein said side walls fit within one another in a precise manner such that failure to extract the cover from the base in an aligned position will cause the cover to jam.

5. A protective device for limiting access to an electrical receptacle, comprising:

a box-like member including a base having a bottom wall and three side walls attached thereto, a cover having a top wall and three side walls attached thereto, and a common wall that is hingedly connected to each of said bottom wall and said top wall so that an enclosure is formed when said three side walls of said base are placed adjacent to the three side walls of said cover, respectively; and at least three latches for securing said cover to said base and thereby enclosing said box-like member, said latches being normally biased to a state which causes said cover to be secured to said base so that all latches must be actuated simultaneously in order to permit said cover to be disengaged from said base, one of said latches being disposed on one of said side walls and the other two latches being disposed on the two side walls adjacent to said one side wall and at locations remote from said one side wall to inhibit simultaneous actuation thereof by small children.

* * * * *